US007097472B2

(12) United States Patent
Parker

(10) Patent No.: US 7,097,472 B2
(45) Date of Patent: Aug. 29, 2006

(54) UNIVERSAL SERIAL BUS PLUG

(75) Inventor: Jeffrey C. Parker, Magnolia, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 7 days.

(21) Appl. No.: 10/936,637

(22) Filed: Sep. 8, 2004

(65) Prior Publication Data

US 2006/0052001 A1 Mar. 9, 2006

(51) Int. Cl.
*H01R 13/44* (2006.01)

(52) U.S. Cl. ..... 439/131

(58) Field of Classification Search ..... 439/131, 439/357, 170, 361–362, 368, 344, 501, 172
See application file for complete search history.

(56) References Cited

U.S. PATENT DOCUMENTS

| | | | | |
|---|---|---|---|---|
| 5,692,914 | A | 12/1997 | Mitani et al. | |
| 6,056,578 | A | 5/2000 | Lin | 439/358 |
| 6,351,388 | B1 * | 2/2002 | Jenkins et al. | 361/730 |
| 6,456,500 | B1 | 9/2002 | Chen | |
| D466,868 | S * | 12/2002 | Gershfeld | D13/139.4 |
| 6,567,273 | B1 | 5/2003 | Liu et al. | 361/737 |
| 6,632,098 | B1 * | 10/2003 | Wong et al. | 439/131 |
| 6,744,634 | B1 | 6/2004 | Yen | 361/752 |
| 6,776,646 | B1 * | 8/2004 | Lee | 439/357 |
| 6,884,104 | B1 * | 4/2005 | Homer | 439/344 |
| 2003/0157836 | A1 | 8/2003 | Morikawa et al. | 439/607 |
| 2004/0077216 | A1 | 4/2004 | Tu | |
| 2004/0103228 | A1 | 5/2004 | Kao | |

FOREIGN PATENT DOCUMENTS

| | | |
|---|---|---|
| DE | 202004001259 | 4/2004 |
| EP | 0697753 | 2/1996 |
| WO | WO98/58425 | 12/1998 |

OTHER PUBLICATIONS

Compaq, et al., "Universal Serial Bus Revision 2.0 specification", *Chapter 6—Mechanical*, Full Document can be found at http://www.usb.org/developers/docs/,(Apr. 27, 2000),85-114.

* cited by examiner

*Primary Examiner*—J. F. Duverne

(57) ABSTRACT

A universal serial bus plug includes a blade having terminals, and a pop-up shell. The pop-up shell includes an active position when spaced from the blade and a storage position when depressed towards the blade.

26 Claims, 6 Drawing Sheets

UNIVERSAL SERIAL BUS PLUG

TECHNICAL FIELD

Various embodiments described herein relate to universal serial buses generally.

BACKGROUND INFORMATION

Various local peripheral devices are coupled to computer systems via a variety of recently developed technologies, such as USB, FireWire, Bluetooth, and other protocols and interfaces. Perhaps the most common of these is the Universal Serial Bus (USB) port, which provides connectivity to one or more peripheral devices at significantly higher speed than traditional serial ports.

The USB may have a plug-and-play interface to search for and load an appropriate device driver for the coupled peripheral device, if such a driver is available.

Some peripheral devices, such as flash memory modules, may include a USB plug. The physical size of the flash memory module may be determined, at least in part, by the size of the industry standard USB plug.

DETAILED DESCRIPTION

The following description includes terms, such as "up", "down", "upper", "lower", "first", "second", etc. that are used for descriptive purposes only and are not to be construed as limiting. The embodiments of a device or article described herein can be manufactured, used, or shipped in a number of positions and orientations.

The functions or algorithms described herein are implemented in hardware, and/or software in embodiments. The software comprises computer executable instructions stored on computer readable media such as memory or other types of storage devices. The phrase "computer readable media" is also used to represent software-transmitted carrier waves. Further, such functions correspond to modules, which are software, hardware, firmware, or any combination thereof. Multiple functions are performed in one or more modules as desired, and the embodiments described are merely examples. A digital signal processor, ASIC, microprocessor, or any other type of processor operating on a system, such as a personal computer, server, a router, or any other device capable of processing data including network interconnection devices executes the software.

Some embodiments implement the functions in two or more specific interconnected hardware modules or devices with related control and data signals communicated between and through the modules, or as portions of an application-specific integrated circuit. Thus, the example process flow is applicable to software, firmware, and hardware implementations.

The phrase "Universal Serial Bus" (USB) as used herein includes a communication link for all types of consumer electronics or peripheral devices including high-speed computers, personal computers, data transfer devices, gaming devices, televisions, cellular telephones, personal digital assistants (PDAs), workstations, data storage devices, DVD drives, speakers, headphones, microphones, keyboards and/or input data controllers, vehicles, flash media players, any USB series connectors, printers, scanners, faxes, network interface, cellphone, telephony communication devices, audio and/or video devices, cameras, MP3 devices, radios, video players, modems, processors, application-specific modules, or any other electronic device.

Figure 6A:
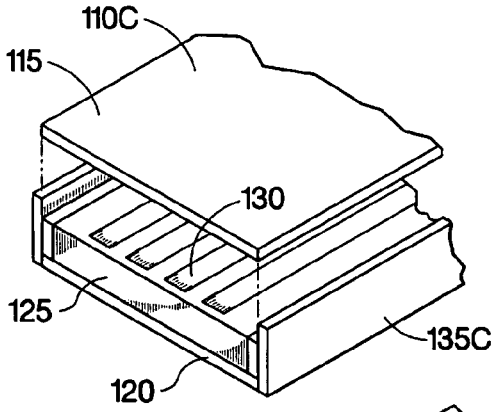
FIGS. 6A and 6B illustrate a USB plug in an active position and in a storage position, respectively, in an example embodiment.

The distance from the upper shell 115 to the lower shell 120 is about the standard USB height in the active position or extended mode of embodiments herein, including the example embodiment of FIG. 6A. The width of the shell 112 is also about USB standard width to be received into a standard USB receptacle 50 in embodiments herein.

The USB male connector may be part of the peripheral device. The USB female connector or USB receptacle may be an external connector in the host computer.

Applications that may include the apparatus and systems of various embodiments include a USB plug with a pop-up shell having a storage position to be received into an electronic device, and an active position to adapt into a USB receptacle. In an embodiment, the USB plug is upstream towards a host system and the USB receptacle is part of the host system.

Figure 1:
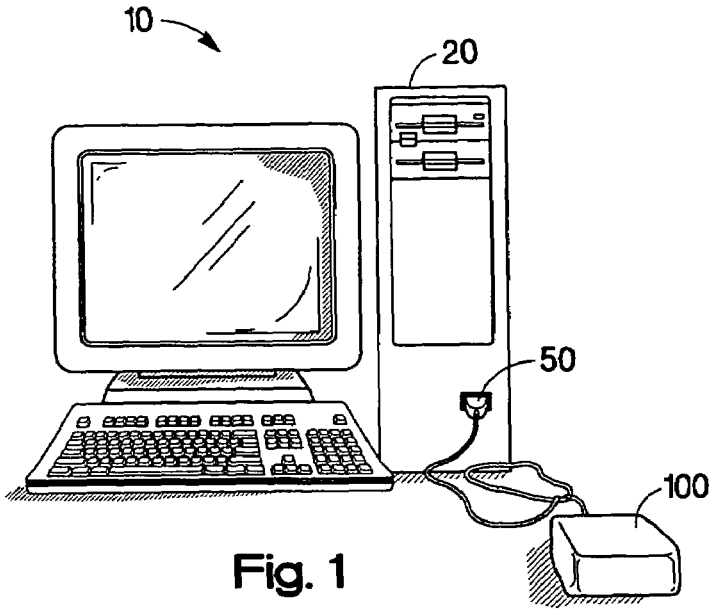
FIG. 1 illustrates a system including a host computer and a corresponding device in an example embodiment.

FIG. 1 illustrates a system 10 including a host computer 20 and a corresponding device 100 in an embodiment. The host computer 20 includes a USB receptacle 50.

Figure 2:
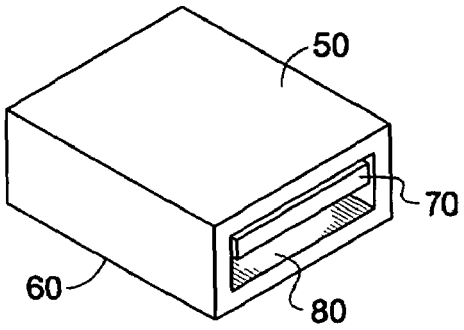
FIG. 2 illustrates a universal serial bus receptacle in an example embodiment.

FIG. 2 illustrates the USB receptacle 50 in an embodiment. The receptacle 50 is a female connector corresponding to a male USB plug 110, as illustrated, for example, in FIG. 3. The receptacle 50 includes a shell housing 60 and a blade 70 with terminals (not shown). The shell housing 60 and the blade 70 define a recess 80 to receive a corresponding blade (125 in FIG. 3) from the USB plug 110.

In an embodiment, the USB receptacle complies with USB industry standards found in the USB Specification at http://www.usb.org/developers/docs.

Figure 3:
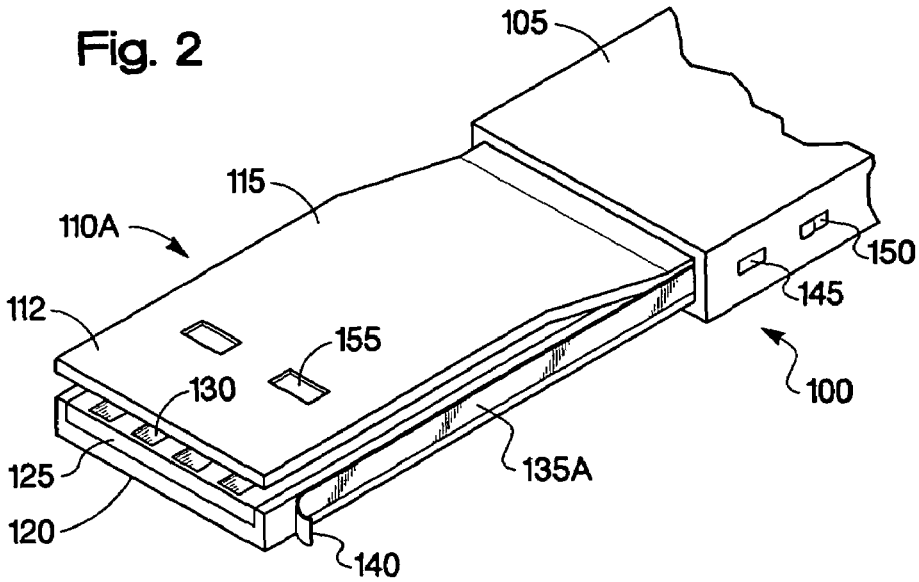
FIG. 3 illustrates a device with a USB plug in an active position in an example embodiment.

FIG. 3 illustrates a peripheral device 100 with the USB plug 110A in an active position in an embodiment. In an embodiment, the USB plug 110A in the active position complies with USB industry standards found in the USB Specification at http://www.usb.org/developers/docs.

The device 100 includes a housing 105 and the USB plug 110A. The USB plug includes a pop-up shell 112. The pop-up shell includes an upper shell 115, and a lower shell 120, in an embodiment. In an embodiment, the pop-up shell 112 provides a ground for the plug. In an embodiment, the pop-up shell includes metal. In an embodiment, the USB plug 110A includes a blade 125. The blade includes terminals 130 that correspond to terminals of the blade 70.

In an embodiment, the blade 126 is between the upper and lower shells. In another embodiment, the pop-up shell 112 does not include the lower shell, and uses the blade 125 as a lower portion of the USB plug 110A.

The upper shell 115 includes stamped metal to predispose the pop-up shell to spring away from the blade 125. In an embodiment, the "pop-up shell" 112 refers to the shell of the USB plug upwardly-lifting with a mechanism that forces the shell to move quickly upward. In an embodiment, the plug emerges substantially quickly from a recessed (storage or concealed) position when activated. The upper shell 115 emerges when a switch 150 on the device 100, for example, is activated. In an additional embodiment, the shell 112 moves out of the device to form the industry standard USB plug upon prompting from a user.

The USB plug 110A may include a side arm 135A. The side arm may be used to align the plug into the receptacle at FIG. 2. In an embodiment, the side arm is used to ground the plug and makes electrical contact with inner walls of the USB receptacle shell. In a particular embodiment, the pop-up shell includes metal. In an embodiment, the side arm 135A includes spring fingers 140. The side arm 135A may be coupled to the pop-up shell and/or the blade to move with the pop-up shell and/or the blade. The spring fingers 140 may be coupled to the housing 105 via a recess and/or a latch 145 in a side of the housing 105, when the plug is in a storage position, in an example embodiment illustrated in FIG. 4B.

Figure 4A:
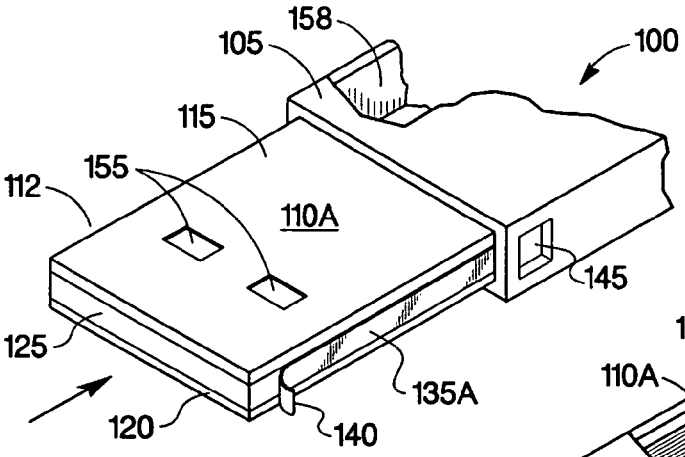
FIGS. 4A and 4B illustrate the USB plug of FIG. 3 in a collapsed position and in a storage position, respectively, in an example embodiment.
Figure 4B:
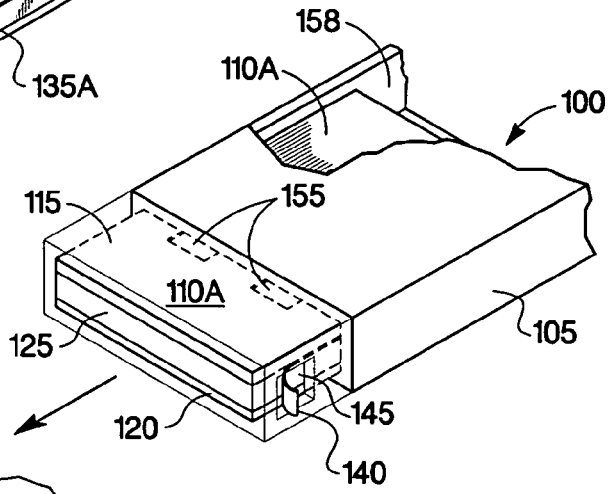

In an embodiment, the housing 105 includes the switch 150 to activate moving, such as translating, the plug 110A between an active position, as shown in FIG. 3 for example, and a storage position, as shown in FIG. 4B for example. In embodiments, the switch 150 may be a button or a sliding switch, for example.

In an embodiment, the upper shell 115 includes one or more openings 155. Each opening 155 may receive a bump (not shown) correspondingly located on an inner wall of the housing 105 to removably secure the upper shell 115, along with the blade 125, within the housing, in an example embodiment.

FIGS. 4A and 4B illustrate the USB plug 110A in a collapsed position and a storage position, respectively, in an embodiment. FIG. 4A illustrates the pop-up shell flattened with the upper shell 115 and the lower shell 120 in the collapsed position. The upper shell 115 is positioned closer to the blade 125 in the collapsed position as compared with the active position, in an example embodiment. In an additional embodiment, the lower shell 120 is positioned closer to the blade when in the collapsed position as compared with the active position. The housing 105 includes a recess 158 to receive the pop-up shell 112 and the blade 125 when the plug is in the storage position.

As shown in FIG. 4B, the collapsed pop-up shell 112 with the substantially enclosed blade 125 are in the recess 158 and are removably secured within the housing 105, as discussed herein. In an additional embodiment, the lower shell 120 moves with the upper shell 115 and the blade 125 into the recess 158 in the storage position.

The switch 150 may activate the plug 110A to eject from the housing 105 to the active position of FIG. 3, in an example. In an embodiment, the switch 150 is translated in a same direction in which the plug 110A is to translate. When the switch 150 is moved towards a front of the housing 105, the pop-up shell with the blade moves from out of the recess 158 in the storage position shown in FIG. 4B to the collapsed position shown in FIG. 4A. As the switch is further moved towards the front, the upper shell 115 separates from the blade 125 in the active position shown in FIG. 3.

When prompted, such as by activating the switch 150, the plug moves from the active position to the storage position. In a particular embodiment, the pop-up shell with the blade moves into the recess 158 of the housing 105 while the upper shell 115 moves toward the blade 125 in the storage position.

Figure 5A:
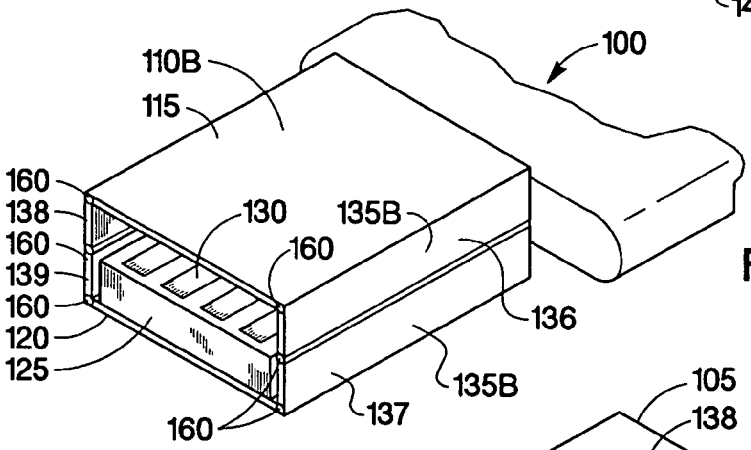
FIGS. 5A and 5B illustrate a USB plug in an active position and in a storage position, respectively, in an example embodiment.
Figure 5B:
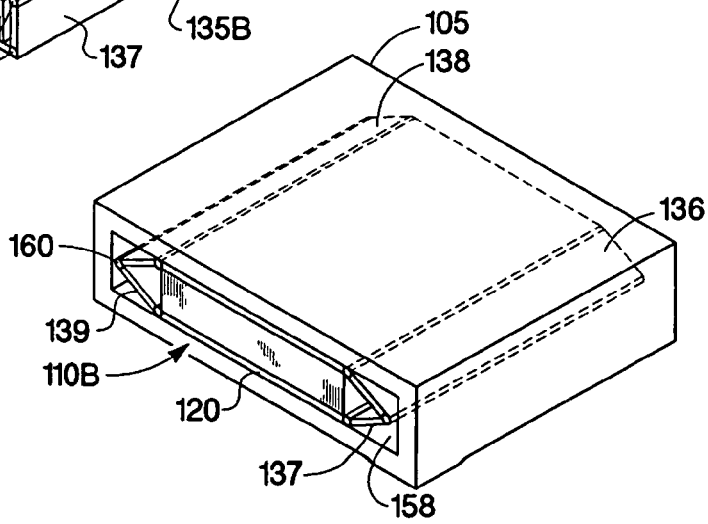

In another example, the switch 150 may activate a mechanism in FIG. 3 to pull the pop-up shell 112 towards the blade to the collapsed position, as shown in FIG. 4A, and/or to pull or slide the plug 110A into the device 100 to the storage position, as shown in FIG. 4B. FIGS. 5A and 5B illustrate the USB plug 110B in an active position and in a storage position, respectively, in an embodiment. The USB plug 110B in the active position complies with USB industry standards found in the USB Specification at http://www.usb.org/developers/docs in an embodiment. In the storage position of FIG. 5B, the plug 10B is substantially enclosed within the recess 158 of the device housing 105.

The pop-up shell 112 includes the side arms 135B, in an embodiment. The side arms 135B include a first arm 136 coupled with the upper shell 115 and hinged to a first arm 137, which is coupled with the lower shell 120. The side arms 135B may also include a second arm 138 coupled with the upper shell and hinged to a second arm 139, which is coupled with the lower shell.

The first arm 136 and the second arm 138 may be coupled to the upper shell 115 by respective hinges 160, in an embodiment. In a further embodiment, the first arm 137 and the second arm 139 may be coupled to the lower shell 120 by respective hinges 160, in an embodiment. The first arms 136, 137 and the second arms 138, 139 may be respectively hinged together with hinges 160.

As shown in FIG. 5A, when the plug is in the active position, the hinges are in a first position to form the plug to comply with USB industry standards. As shown in FIG. 5B, when the plug 110B is in the storage position, the hinges are in a second position to store the plug within the housing 105. The hinges 160 between the first arms and the hinges between the second arms protrude out from each respective side of the blade in this embodiment. In embodiments, the side arms 135B are double-hinged to move between the active and storage positions.

When prompted, such as by activating the switch 150, the pop-up shell with the blade moves from out of the recess 158 in the storage position of FIG. 5B. Then, the upper shell 115 of the pop-up shell of the plug 110 separates from the blade 125, and the side arms 136, 137, 138, 139 straighten out to the active position shown in FIG. 5A.

When prompted, such as by activating the switch 150, the plug moves from the active position to the storage position. In a particular embodiment, the side arms 135B buckle at the hinges 160 to move the upper shell towards the blade. The upper shell translates substantially straight down to the blade 125. The plug moves into the recess 158 of the housing 105 to the storage position.

In another embodiment not shown, the upper shell translates to one side and translates towards the blade, with the side arms 135B remaining substantially straight, as to have the pop-up shell 112 form a parallelogram in the storage position. In an embodiment, there are no hinges between the first arms 136, 137, and no hinges between the second arms 138, 139.

Figure 6B:
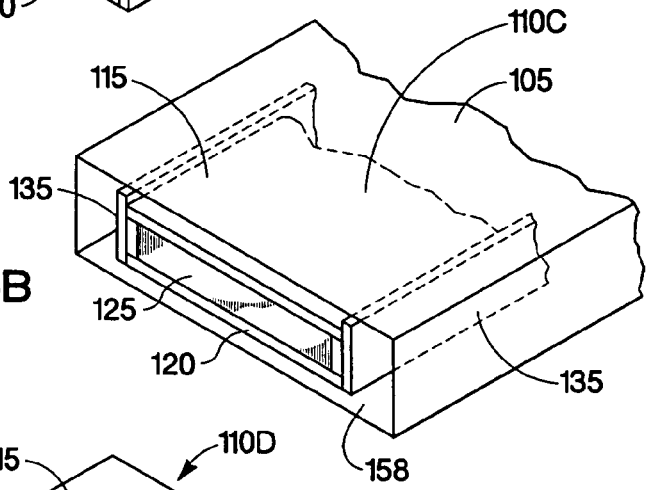

FIGS. 6A and 6B illustrate a USB plug 110C in an active position and in a storage position, respectively, in an embodiment. In an embodiment, the USB plug 110C in the active position complies with USB industry standards found in the USB Specification at http://www.usb.org/developers/docs.

As shown in the example embodiment of FIG. 6A, the plug 110C includes side arms 135C. In an embodiment, the side arms 135C include a pair of side posts or side blades in a substantially fixed position relative to the lower shell 120. In an additional embodiment, the side arms 135C are substantially integral with the lower shell. The height of the side blade may extend above the blade 125 at a distance that is about the same as a thickness of the upper shell 115. In the example embodiment of FIG. 6B, the upper shell 115 is positioned adjacent the blade 125 between the side blades 135C to substantially enclose the blade 125 in the storage position.

When prompted, such as by activating the switch 150, the pop-up shell with the blade moves from out of the recess 158 in the storage position of FIG. 6B. The upper shell 115 of the pop-up shell then separates from the blade 125 and the side arms 135C to expand to the active position shown in FIG. 6A.

When prompted, such as by activating the switch 150, the plug moves from the active position to the storage position. In a particular embodiment, the upper shell moves toward the blade and between the side arms 135C. The plug moves into the recess 158 of the housing 105 to the storage position.

Figure 7A:
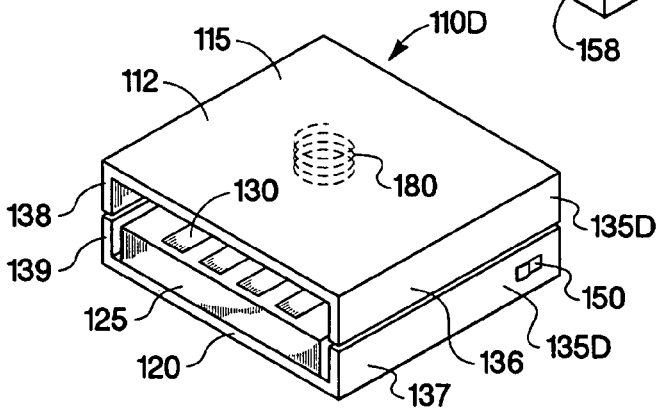
FIGS. 7A and 7B illustrate a USB plug in an active position and in a storage position, respectively, in an example embodiment.
Figure 7B:
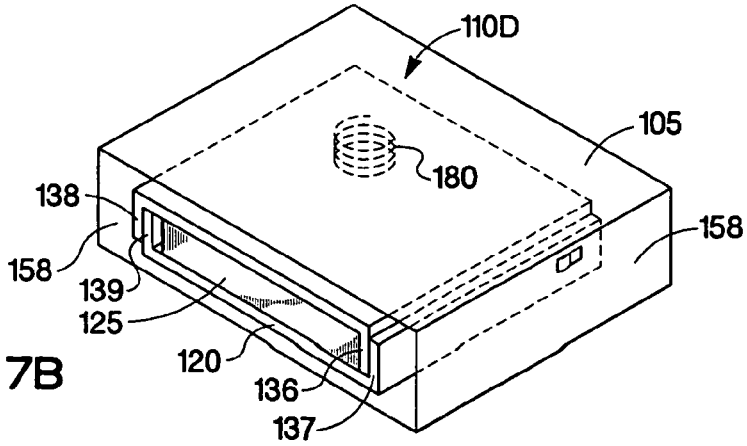

FIGS. 7A and 7B illustrate a USB plug 110D in an active position and in a storage position, respectively, in an embodiment. In an embodiment, the USB plug 110D in the active position complies with USB industry standards found in the USB Specification at http://www.usb.org/developers/docs.

The pop-up shell 112 includes the side arms 135D, in an embodiment. The side arms 135D include a first side arm with a first arm 136 of the upper shell 115 and a first arm 137 of the lower shell 120, and a second side arm with a second arm 138 of the upper shell and a second arm 139 of the lower shell.

As shown in FIG. 7A, when the plug 110D is in the active position, the pop-up shell 112 is in a first position to comply with USB industry standards. In the first position, the first arm 136 and the first arm 137 are extended to be positioned in series and substantially straight along the first side arm, and the second arm 138 and the second arm 139 are extended to be positioned in series and substantially straight along the second side arm.

As shown in FIG. 7B, when the plug 110D is in the storage position, the first arms 136 and 137 are adjacent each other and positioned in parallel, the second arms 138 and 139 are also adjacent each other and positioned in parallel, and the upper shell 115 is adjacent the blade 125. The first and second arms remain substantially perpendicular to the upper shell and to the lower shell, respectively, in each position.

When prompted, such as by activating the switch 150, the plug moves from the active position to the storage position. In transition from the active position to the storage position, the upper shell 115 shifts with respect to the lower shell 120 towards a side. In an example embodiment, the upper shell 115 translates to one side and translates towards the blade. In the embodiment of the storage position as shown, the first arm 136 is positioned between the second arm 137 and the blade 125. In an additional embodiment, the second arm 139 is positioned between the second arm 138 and the blade 125. In an alternative embodiment, the shift of the upper shell is in the opposite direction. In an additional embodiment, the lower shell 120 moves with the upper shell 115 and the blade 125 into the recess 158, in the storage position.

In an embodiment, the plug 110 and/or the device 100 includes the internal spring mechanism 180. The internal spring mechanism 180 is compressed when the plug is in the storage position.

When prompted, such as by activating the switch 150, the pop-up shell with the blade moves from out of the recess 158 in the storage position of FIG. 7B. The compressed spring mechanism 180 then expands the pop-up shell of the plug 110 to separate the shell from the blade to bring the plug into the active position of FIG. 7A. The upper shell shifts over the lower shell such that the side arm 136 aligns with the side arm 137, and the side arm 138 aligns with the side arm 139.

Figure 8A:
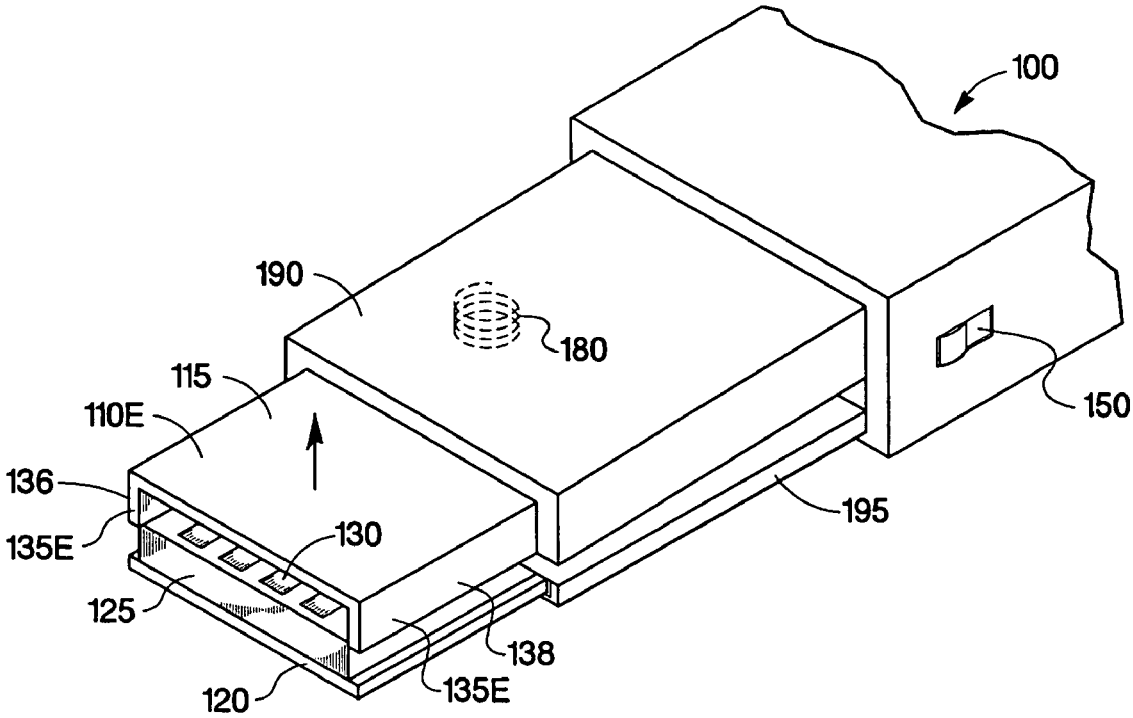
FIGS. 8A and 8B illustrate a USB plug in an active position and in a storage position, respectively, in an example embodiment.
Figure 8B:
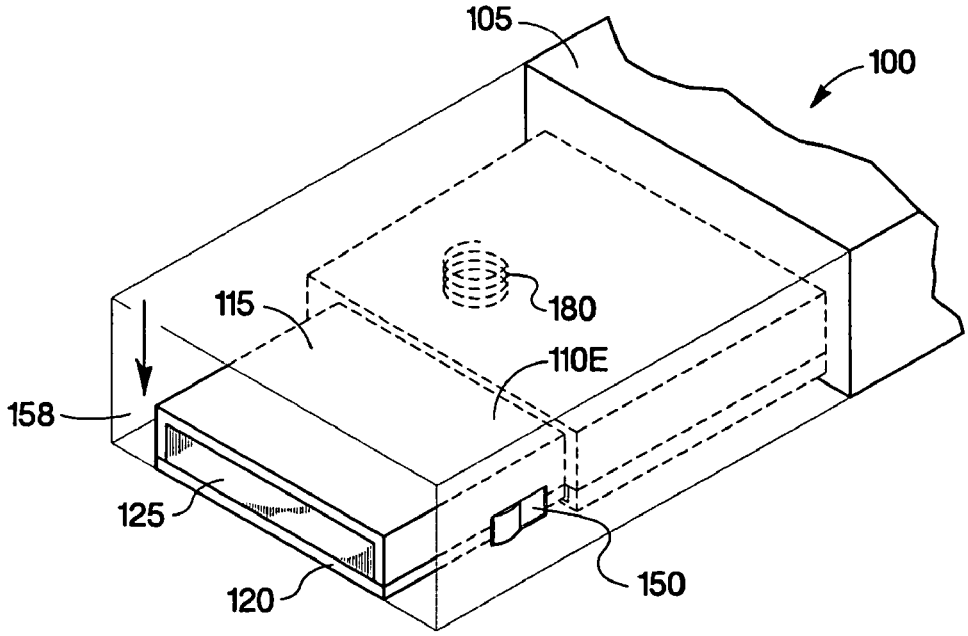

FIGS. 8A and 8B illustrate a USB plug in an active position and a storage position, respectively, in an embodiment. In an embodiment, the USB plug 110E in the active position complies with USB industry standards found in the USB Specification at http://www.usb.org/developers/docs.

The pop-up shell 112 may include a pair of side arms 135E. The side arms 135D include the first side arm 136 of the upper shell 115, and the second first arm 138 of the upper shell. The side arms may extend perpendicular away from the upper shell 115 towards the lower shell. The side arms may be integral with the upper shell. The height of the side arms 136, 138 from the upper shell may include the height of the blade and the height of the lower shell to substantially form a compact rectangle in the embodiment of the storage position.

The device 100 may include an overmold 190 and a bottom mold 195. In an embodiment, the overmold 190 is coupled to the upper shell 115 and the bottom mold 195 is coupled to the lower shell 120. The top mold 190, in response to the internal spring mechanism 180, moves relative to the bottom mold 195.

The internal spring mechanism 180 may be compressed when the plug is in the storage position. When the switch 150 is activated, the pop-up shell with the blade moves from out of the recess 158, out of the storage position of FIG. 8B. Then, the compressed spring mechanism 180 expands the pop-up shell of the plug 110 to the active position of FIG. 8A, where the upper shell 115 with the side arms 135E separates from the blade and the lower shell 120.

When prompted, such as by activating the switch 150, the plug moves from the active position to the storage position. In a particular embodiment, the upper shell with the side arms 136, 138 moves toward the blade. The plug moves into the recess 158 of the housing 105 to the storage position.

Figure 9:
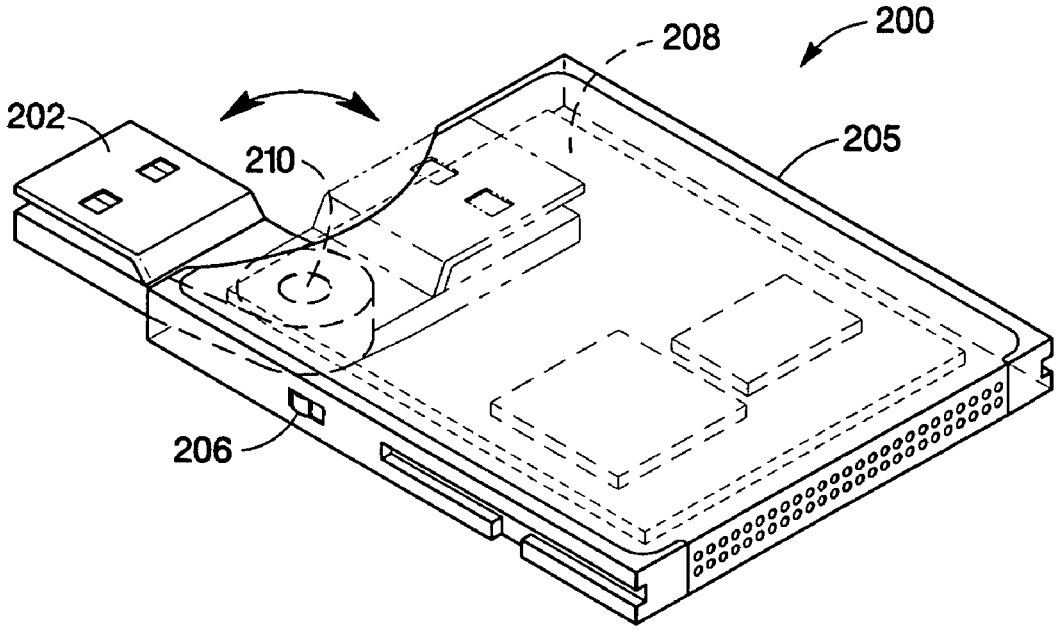
FIG. 9 illustrates a USB plug swiveling between an active position and a storage position within a device, in an example embodiment.

FIG. 9 illustrates a USB plug 202 swiveling between an active position and a storage position within a device 200, in an embodiment. The device 200 includes a housing 205. The housing 205 includes a switch 206 to release the plug 202 to swivel out of a recess 208 of the housing 205. In an embodiment, the housing 202 includes a hinge 210 about which the plug swivels. In an additional embodiment, a user may pull on the plug 202 to swivel the plug into the active position, and may push the plug 202 back into the storage position. In embodiments, any of the plug embodiments of FIGS. 3 to 8B may be used with the device 200 of FIG. 9.

Figure 10:
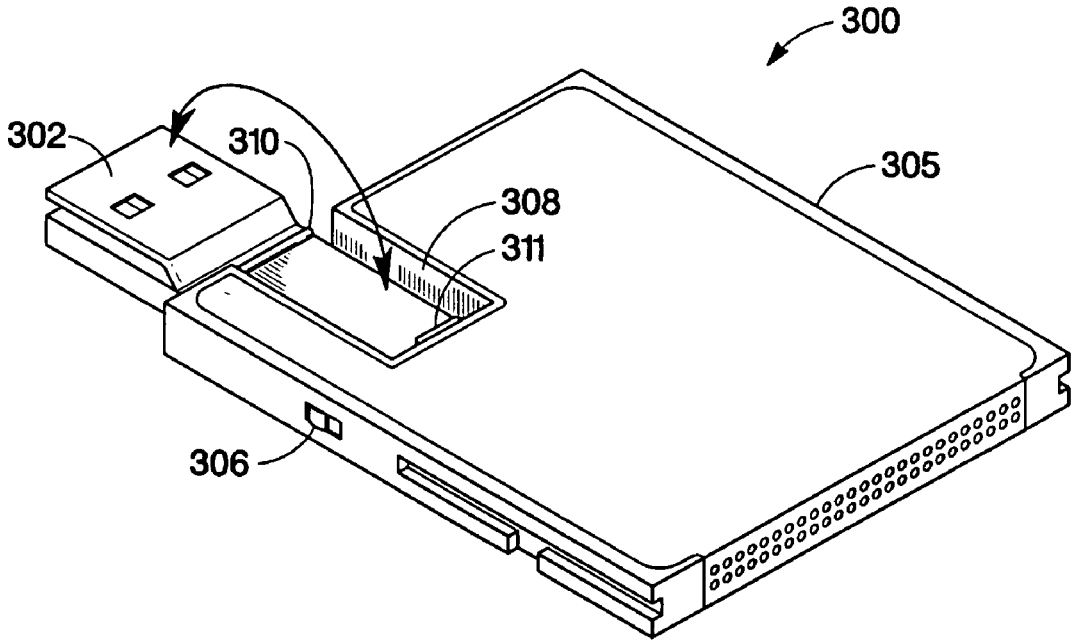
FIG. 10 illustrates a USB plug flipping between an active position and a storage position within a device, in an example embodiment.

FIG. 10 illustrates a USB plug 302 flipping between an active position and a storage position within a device 300, in an embodiment. The device 300 includes a housing 305. The housing 305 includes a switch 306 to release the plug 302 to flip out of a recess 308 of the housing 305. In an embodiment, the housing 302 includes a hinge 310 about which the plug flips.

In an additional embodiment, a user may pull on the plug 202 to flip the plug into the active position, and may push the plug 202 back into the storage position. In an additional embodiment, the housing 305 includes a securing mechanism 311 to releasably secure the plug within the recess 308. The securing mechanism 311 may include a releasable latch on the device and a releasable hook on the plug, for example.

In embodiments, any of the plug embodiments of FIGS. 3 to 8B may be used with the device 300 of FIG. 10.

Figure 11:
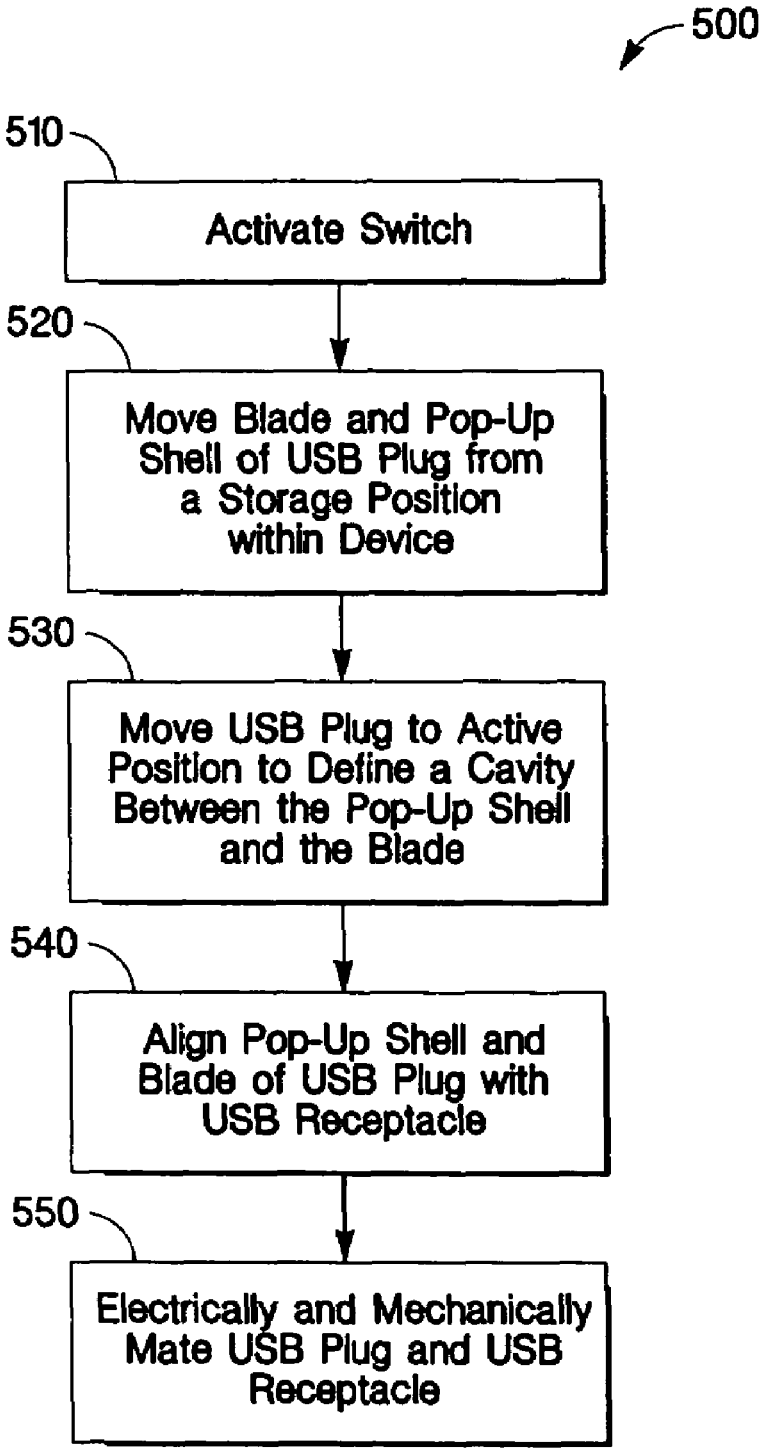
FIG. 11 illustrates a process of mating a USB plug and a USB receptacle according to various example embodiments.

FIG. 11 illustrates a process of mating a USB plug and a USB receptacle according to various embodiments. At block 510, a switch on a device is activated to bring the plug out of the storage position. In another embodiment, a user directly activates the plug. At block 520, the blade 125 of the plug, and the pop-up shell 112 of the plug move from a storage position within the device upon prompting of the switch or upon activation from a user. At block 530, as the pop-up shell of the plug moves away from the blade, a cavity is defined therebetween. The plug is then in the active position. At block 540, the blade 125 of the plug is aligned with the recess 80 of the USB receptacle, while the pop-up shell 112 is aligned with the shell housing 60 of the USB receptacle. At block 550, the USB plug and the USB receptacle are electrically and mechanically aligned, and coupled when the plug is in an active position.

Applications that may include the apparatus and systems of various embodiments broadly include a variety of electronic and computer systems. The elements, materials, geometries, dimensions, and sequence of operations can all be varied to suit particular packaging requirements.

The microelectronic device can be implemented in a number of different embodiments. The elements, materials, geometries, dimensions, and sequence of operations can all be varied to suit particular applications. Parts of some embodiments may be included in, or substituted for, those of other embodiments. Various embodiments also could be used in conjunction with various types of electronic assemblies, such as printed circuit (PC) boards or other electronic circuit housings and is not meant to be limited in use.

FIGS. 1 to 11 are merely representational and are not drawn to scale. Certain proportions thereof may be exaggerated, while others may be minimized. Many other embodiments will be apparent to those of skill in the art upon reviewing the above description. Parts of some embodiments may be included in, or substituted for, those of other embodiments. While the foregoing examples of dimensions and ranges are considered typical, the various embodiments are not limited to such dimensions or ranges.

The illustrations of embodiments described herein are intended to provide a general understanding of the structure of various embodiments, and they are not intended to serve as a complete description of all the elements and features of apparatus and systems that might make use of the structures described herein. The accompanying drawings that form a part hereof show by way of illustration, and not of limitation, specific embodiments in which the subject matter may be practiced.

Embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus the following claims are hereby incorporated into the Detailed Description, with each claim standing on its own as a separate embodiment.

It will be readily understood to those skilled in the art that various other changes in the details, material, and arrangements of the parts and method stages which have been described and illustrated in order to explain the nature of embodiments herein may be made without departing from the principles and scope of embodiments as expressed in the subjoined claims.

What is claimed is:

1. A system comprising:

a universal serial bus plug including a blade and a depressible, pop-up shell, wherein the pop-up shell includes an active position when separated from the blade and a storage position when depressed towards the blade.

2. The system of claim 1 wherein the pop-up shell includes at least one of an upper shell and a lower shell, wherein the upper shell moves from the active position to the storage position relative to the blade.

3. The system of claim 1 further comprising a universal serial bus receptacle to electrically and mechanically couple with the universal serial bus plug in the active position.

4. The system of claim 3 wherein the pop-up shell, together with the blade, at least one of electrically couple and mechanically couple with the universal serial bus receptacle.

5. The system of claim 4 wherein the universal serial bus plug includes a side arm between an upper shell of the pop-up shell and a lower shell of the pop-up shell to at least one of electrically couple and mechanically couple the plug with the receptacle.

6. The system of claim 1 further comprising a switch to activate a change between the active position and the storage position.

7. The system of claim 1 wherein the universal serial bus plug includes a spring mechanism coupled with the pop-up shell to activate the active position.

8. The system of claim 1 further comprising a device coupled with the universal serial bus plug, wherein the device includes a recess to receive the universal serial bus plug when the pop-up shell is in the storage position.

9. The system of claim 8 further comprising a securing mechanism to releasably hold the universal serial bus plug in the recess of the device.

10. The system of claim 1 further comprising an overmold coupled with an upper shell of the pop-up shell, and a bottom mold coupled with a lower shell of the pop-up shell, wherein the overmold and the upper shell respectively move away from the bottom mold and the lower shell when the pop-up shell moves from the storage position to the active position.

11. A universal serial bus plug comprising:

a blade having terminals; and a pop-up shell including an active position when spaced from the blade and a storage position when adjacent the blade.

12. The universal serial bus plug of claim 11 wherein the pop-up shell includes an upper shell, a lower shell, and at least one side arm coupled to at least one of the lower shell and the upper shell, wherein the pop-up shell shifts to a side when moving between positions.

13. The universal serial bus plug of claim 11 wherein the universal serial bus plug includes a spring mechanism coupled with the pop-up shell to activate the pop-up position.

14. The universal serial bus plug of claim 11 further comprising a side arm to substantially enclose the blade with the pop-up shell when the pop-up shell is in the storage position.

15. The universal serial bus plug of claim 11 further comprising a side arm, wherein the side arm includes a set of spring fingers.

16. The universal serial bus plug of claim 11 further comprising a side arm, wherein the side arm includes a set of side blades.

17. The universal serial bus plug of claim 11 further comprising a side arm, wherein the side arm includes a hinge, wherein the hinge rotates from a first position to a second position when the pop-up shell moves from the active position to the storage position.

18. The universal serial bus plug of claim 11 further comprising a side arm, further comprising two double-hinged side arms coupling an upper shell of the pop-up shell and a lower shell of the pop-up shell, wherein the blade is adjacent the lower shell.

19. A method comprising:

moving a blade of a universal serial bus plug together with a pop-up shell of the universal serial bus plug from a storage position within a device to an active position; and defining a cavity between the pop-up shell and the blade, when the blade and the pop-up shell are moved to the active position.

20. The method of claim 19 further comprising activating a switch on the device to move the blade and the pop-up shell, and to define the cavity.

21. The method of claim 19 further comprising electrically and mechanically coupling the universal serial bus plug with a universal serial bus receptacle.

22. The method of claim 19 wherein moving the blade and the pop-up shell includes swiveling the universal serial bus plug from the storage position to the active position.

23. The method of claim 19 wherein moving the blade and the pop-up shell includes flipping the universal serial bus plug from the storage position to the active position.

24. The method of claim 19 wherein moving the blade and the pop-up shell includes sliding the universal serial bus plug from the storage position to the active position.

25. The method of claim 19 wherein when the blade and the pop-up shell are moved to the active position, the plug substantially complies with an industry standard universal serial bus plug.

26. The method of claim 19 further comprising releasably holding the universal serial plug in the storage position in a recess of the device via a securing mechanism, wherein the plug includes a spring finger, and the device includes a latch, wherein the securing mechanism includes the spring finger and the latch.

* * * * *

UNITED STATES PATENT AND TRADEMARK OFFICE

CERTIFICATE OF CORRECTION

PATENT NO. : 7,097,472 B2
APPLICATION NO. : 10/936637
DATED : August 29, 2006
INVENTOR(S) : Jeffrey C. Parker It is certified that error appears in the above-identified patent and that said Letters Patent is hereby corrected as shown below:

In column 4, line 27, delete “10B” and insert -- 110B --, therefor.

Signed and Sealed this

Third Day of March, 2009

JOHN DOLL
*Acting Director of the United States Patent and Trademark Office*